US007290430B2

(12) United States Patent
Hagel

(10) Patent No.: US 7,290,430 B2
(45) Date of Patent: Nov. 6, 2007

(54) TRANSFERRING DEVICE

(76) Inventor: Martin Hagel, Bruckner Strasse 25, Weingarten (DE) D-88250

( * ) Notice: Subject to any disclaimer, the term of this patent is extended or adjusted under 35 U.S.C. 154(b) by 31 days.

(21) Appl. No.: 10/517,708

(22) PCT Filed: Jun. 17, 2002

(86) PCT No.: PCT/EP02/06651

§ 371 (c)(1),
(2), (4) Date: Aug. 22, 2005

(87) PCT Pub. No.: WO03/106069

PCT Pub. Date: Dec. 24, 2003

(65) Prior Publication Data

US 2006/0104796 A1 May 18, 2006

(51) Int. Cl.
*B21D 43/05* (2006.01)

(52) U.S. Cl. ..... 72/405.16; 198/621.1; 192/150; 72/405.01

(58) Field of Classification Search ..... 72/405.16, 72/405.15, 405.13, 405.09, 405.01; 198/621.1; 192/150, 56.1
See application file for complete search history.

(56) References Cited

U.S. PATENT DOCUMENTS 4,785,657 A 11/1988 Votava
4,873,860 A * 10/1989 Werner ..... 72/405.01
5,267,463 A * 12/1993 Doyama ..... 72/405.16
5,307,666 A * 5/1994 Bianchi ..... 72/405.11
5,390,525 A 2/1995 Fisch
5,488,852 A * 2/1996 Nishikawa et al. ..... 72/405.13
5,680,787 A 10/1997 Fisch
5,802,967 A 9/1998 Thudium et al.

* cited by examiner

*Primary Examiner*—Daniel C Crane
(74) *Attorney, Agent, or Firm*—Wolf, Greenfield & Sacks, P.C.

(57) ABSTRACT

A transferring device includes at least one gripper rail, which can be brought into engagement with at least one workpiece and which can be driven in a lifting direction, a closing direction and an advancing direction. The transferring device also includes at least one lifting drive and/or at least one closing drive, at least one advancing drive, and an arm that is connected to the advancing drive in a manner that enables it to pivot about a pin while moving, to a large extent, parallel to the advancing direction. The transferring device is characterized in that the gripper rail is directly engaged with the arm in the advancing direction and can be displaced in a direction perpendicular to the advancing direction.

4 Claims, 2 Drawing Sheets

TRANSFERRING DEVICE

TECHNICAL FIELD

This application is a 371 of PCT/EP02/06651, filed Jun. 17, 2002.

The invention relates to a transferring device according to the preamble of claim 1.

Transferring devices are used to transport, usually several, workpieces simultaneously through a work tool stepwise so that different machining processes may be performed on the workpieces in sequence at individual workstations. Transferring devices of this kind are frequently used in connection with transfer presses. A transfer press of this kind is used to shape several workpieces located in the press at the same time. The workpiece in question is located at a specific station in the transfer press where it is subjected to a specific shaping process. When it has been transported on to the next station, the workpiece is subjected to stepwise shaping until the final product is obtained.

The transferring device ensures that the individual workpieces are first gripped, lifted and then transported together in the machining direction. The workpieces are then lowered onto the next machining position and the transferring device, in particular its so-called gripper rails, are opened in order to disengage them from the tool. While the workpieces are being machined, the gripper rails are moved backwards against the machining direction in open position so they can close again to initiate the next conversion process and lift the workpieces. Substantially, a transferring device of this kind can perform three movements independently of each other, namely lifting/lowering, opening/closing and advancing/returning. Alternatively, a so-called two-axis transfer may be formed in such a way that only a closing and advancing movement or only a lifting and advancing movement is achieved.

PRIOR ART

Known from U.S. Pat. No. 5,680,787 is a transferring device in which an arm is connected in a hinged manner to the advancing drive. The arm may substantially be pivoted about an axis running parallel to the advancing direction. In the advancing direction, the arm is engaged with a slide in such a way that the slide may be moved in the advancing direction. Moreover, the arm can be moved in relation to the slide so that the slide, to which the gripper rails are attached, can be lifted, lowered, opened and closed without these movements being impeded by the arm of the advancing drive. The disadvantage of this known design is that the arm of the advancing drive acts on a slide to which the gripper rail is attached by several interposed components. This design is, on the one hand, relatively complicated and also requires a relatively strong advancing drive since it is necessary to move the mass of the slide in addition to the mass of the gripper rail.

DESCRIPTION OF THE INVENTION

The object of the invention is to provide an improved transferring device.

This object is achieved by the transferring device described in claim 1.

Accordingly, the transferring device according to the invention comprises at least one gripper rail. Preferably, two gripper rails are provided. The gripper rail can be brought into engagement directly or indirectly with at least one workpiece in order to achieve the workpiece movements described above. As an example, the gripper rail may comprise suitable fingers or blades, bags or other protruding elements to grip and move the workpieces. If there are two gripper rails, they are arranged parallel to each other and grip the workpieces from both sides. To achieve the movements described, the gripper rail may be driven in a lifting direction and/or a closing direction and an advancing direction and in the reverse direction in each case. Accordingly, the transferring device comprises at least one lifting drive and/or at least one closing drive and at least one advancing drive. It should be stressed that the advantages of the measures according to the invention are achieved with a transferring device that comprises either a lifting drive or a closing drive. Preferably, however, both types of drive are present. Insofar, the following will refer to such a three-axis transferring device although, as mentioned, the invention is also applicable to the described two-axis transferring device.

An arm is connected to the advancing drive pivotable about an axis substantially parallel to the advancing direction. This arm transmits the advancing movement from the advancing drive to the gripper rail. According to the invention, this arm is directly engaged with the gripper rail in the advancing direction. In other words, the arm does not drive any interposed elements or slides, but acts directly on the actual gripper rail. In particular, the arm pulls or pushes the gripper rail directly in the advancing direction and hence ensures the required advancing and returning movement.

To ensure that the engagement of the arm with the gripper rail does not impede the other required movements of the gripper rail, namely the lifting/lowering and/or the opening/closing, the gripper rail can be displaced in a direction perpendicular to the advancing direction relative to the arm. The additionally required degree of freedom is achieved by the pivotable connection of the arm to an element of the advancing drive. The arrangement may, for example, be of such a nature that when the gripper rail is lifted or lowered, the gripper rail is displaced relative to the arm. The opening and closing movement taking place in a lateral direction is permitted at the connection between the arm and the gripper rail partly due to the fact that the arm is connected in a hinged manner. Also, the swiveling of the arm changes the height of that position at which the gripper rail is connected to the arm. However, this positional relationship adapts itself by the displaceable connection between the gripper rail and the arm without any unintended change to the height of the gripper rail taking place.

The transferring device according to the invention therefore achieves the necessary movements with a simple structure without disrupting or impeding other movements or influencing them in another way. In an advantageous way, only the arm and the gripper rail have to be moved by the advancing drive. However, these have a relatively low mass so that in an advantageous way a relatively weaker and hence less expensive advancing drive can be used. Reducing the mass to be advanced enables the starting and braking properties of the transfer to be improved. The fact that with the transferring device according to the invention there is no requirement to move any slides, and their mass, connected to the gripper rail also offers the advantage that there is also no need for the slide to be moved during the opening, closing and lifting movements. Another problem with the known arrangement with an advancing bridge consists in that, due to the lever length between the lock cases containing the lifting and/or closing drive, and the advancing drive, during the closing and opening movement, a "dynamic" stress on the gripper rail, for example bending or vibration, occurs during operation. This problem that the presence of the slide may lead to dynamic deformation of the gripper rails in certain situations can also be rectified.

In addition, there is also a clear advantage over the driver bridges conventionally used for the advancing. In the conventional manner, a driver bridge of this type would connect the gripper rails to the advancing drive in such a way that the advancing may be effected, but the lifting/lowering and closing/opening movement is not impeded. A driver bridge of this kind usually extends on the output side of a transfer press transverse to the machining direction where it can significantly impede the removal of the workpieces. In contrast to this, with the transferring device according to the invention, each gripper rail is connected individually to an assigned advancing drive by means of the pivotable or hinged arm. Here, in an advantageous way there is no requirement for components that extend transversely over the press's output and hence the further transportation of the workpiece is not impeded. Finally, in the usual case where two parallel gripper rails are present, the relevant advancing drives may be controlled independently of each other. The fact that the elements to be moved are not mechanically interconnected results in better control performance.

Advantageous further embodiments of the transferring device according to the invention are described in the further claims.

Preferred for the connection of the gripper rails—engaged in the advancing direction but perpendicularly displacable hereto—to the hinged arm is a turning/pushing unit. A unit of this kind can be achieved with simple means in order to ensure the necessary engagements and degrees of freedom. At the same time, a unit of this kind does not have an unnecessarily high mass.

Preferred for the turning/pushing unit is a structure of a kind comprising a guide and a sliding block guided thereon. The guide is connected in an advantageous way to the hinged arm. The sliding block guided thereon is connected rotatably to the gripper rail. The connection between the gripper rail and the sliding block, and between the sliding block and the guide is of a type that ensures that there is engagement in the advancing direction and the necessary movement can be transmitted.

Preferably, the hinged arm has an overload protection. This can, for example, be embodied in the form of a specific component with a defined breaking force/release force. An overload protection of this kind prevents the advancing drive from continuously "trying" to move the gripper rail in the advancing direction even though this movement is impeded in some way. For safety reasons, it is advantageous if, in an overload case of this kind, a component of the hinged arm is broken or released and hence terminates the transmission of force onto the gripper rail. The breaking force/release force can, for example, be set at 1.5 times the force usually required to move the gripper rail and workpieces in engagement therewith or at another suitable value. This causes the overload protection to be released reliably at a relatively low force before a hazardous situation, e.g. a collision or an overloading of the advancing drive, can ensue.

It is currently preferable for overload protection to be provided in the area of the pivotable attachment of the arm to an element of the advancing drive or to a connecting element in the environment of the arm. In particular, the overload protection or the overload safety device can be provided between the slide (26) for the advancing drive, explained below, and the arm, and alternatively between the arm and the gripper rail. For example, here it is possible to use a component with which, when a certain force is exceeded, a bolt is disengaged so that the force transmission ends. This can be combined with a position switch that ensures that the advancing drive is stopped when the overload protection is released.

Finally, it is preferable that the transferring device according to the invention comprises two gripper rails to each of which an advancing drive is assigned. The two advancing drives may be controlled independently of each other. In addition, the elements to be moved thereby, in particular the gripper rails, are not mechanically interconnected, which results in improved control performance.

BRIEF DESCRIPTION OF THE DRAWINGS

The following is a description of the invention with reference to an example of an embodiment shown in the drawings in which.

DETAILED DESCRIPTION OF THE PREFERRED EMBODIMENT OF THE INVENTION

Figure 1:
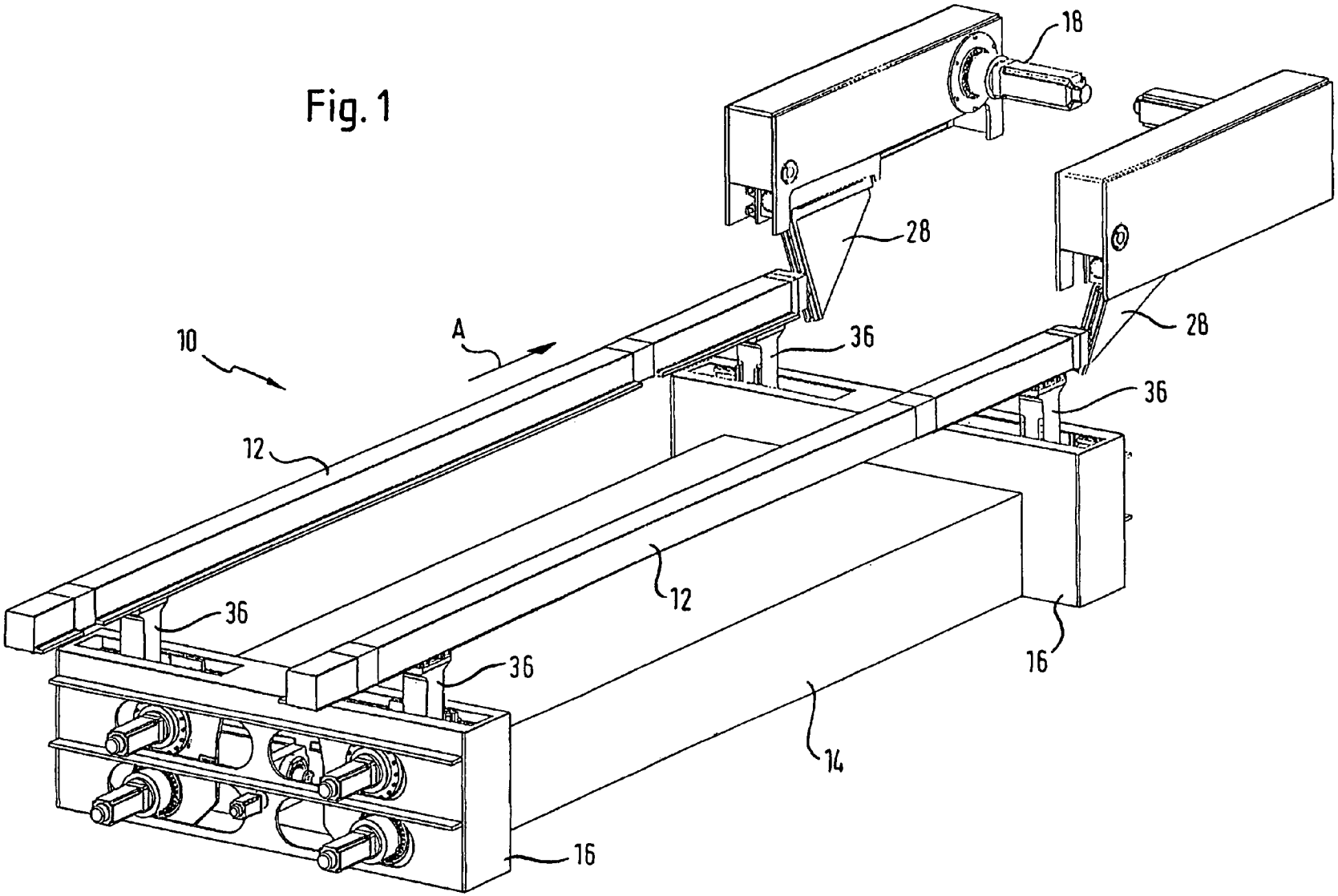
FIG. 1 shows a perspective view of the transferring device according to the invention.

FIG. 1 is a perspective view of the transferring device 10 according to the invention. This comprises two gripper rails 12 arranged parallel to each other by means of which workpieces for machining may be gripped, lifted, advanced in the advancing direction A and lowered and positioned on a downstream machining station. This is followed by the opening of the gripper rails in a lateral direction and the returning of the gripper rails 12 against the advancing direction A. The area in which the workpieces are machined, in a transfer press for example, and in which the workpieces have to be moved, is only indicated schematically in FIG. 1 by the reference number 14.

It should be stated with regard to the movements of gripper rails 12 that the lifting, lowering, opening and closing movements are generated by lifting and closing drives respectively, which—and this is not of direct significance in connection with this invention—are located in two so-called lock cases 16 arranged on the front or rear of the transferring device 10. Independently of each other, these drives enable a lifting of the two gripper rails 12 and a movement of said rails in a lateral, in particular horizontal, direction. The control of the lifting and closing drives is hereby adjusted respectively to ensure that no unwanted lifting and lowering occurs during the opening and closing and vice versa. In order to facilitate the movement in advancing direction A in addition to the movements described above, each gripper rail is mounted displaceably in the advancing direction on a rod 36 which is moved by the lifting and closing drive in the lifting and closing direction.

The gripper rails 12 are each advanced by their respective advancing drives 18. In the embodiment shown, these are each arranged above the gripper rail and slightly laterally offset towards the outside. In addition, the position of the advancing drive in relation to the gripper rails is determined by the position or the aperture width of the gripper rails. The connection of the gripper rail 12 to the advancing drive 18 is explained in the following with reference to FIG. 2.

Figure 2:
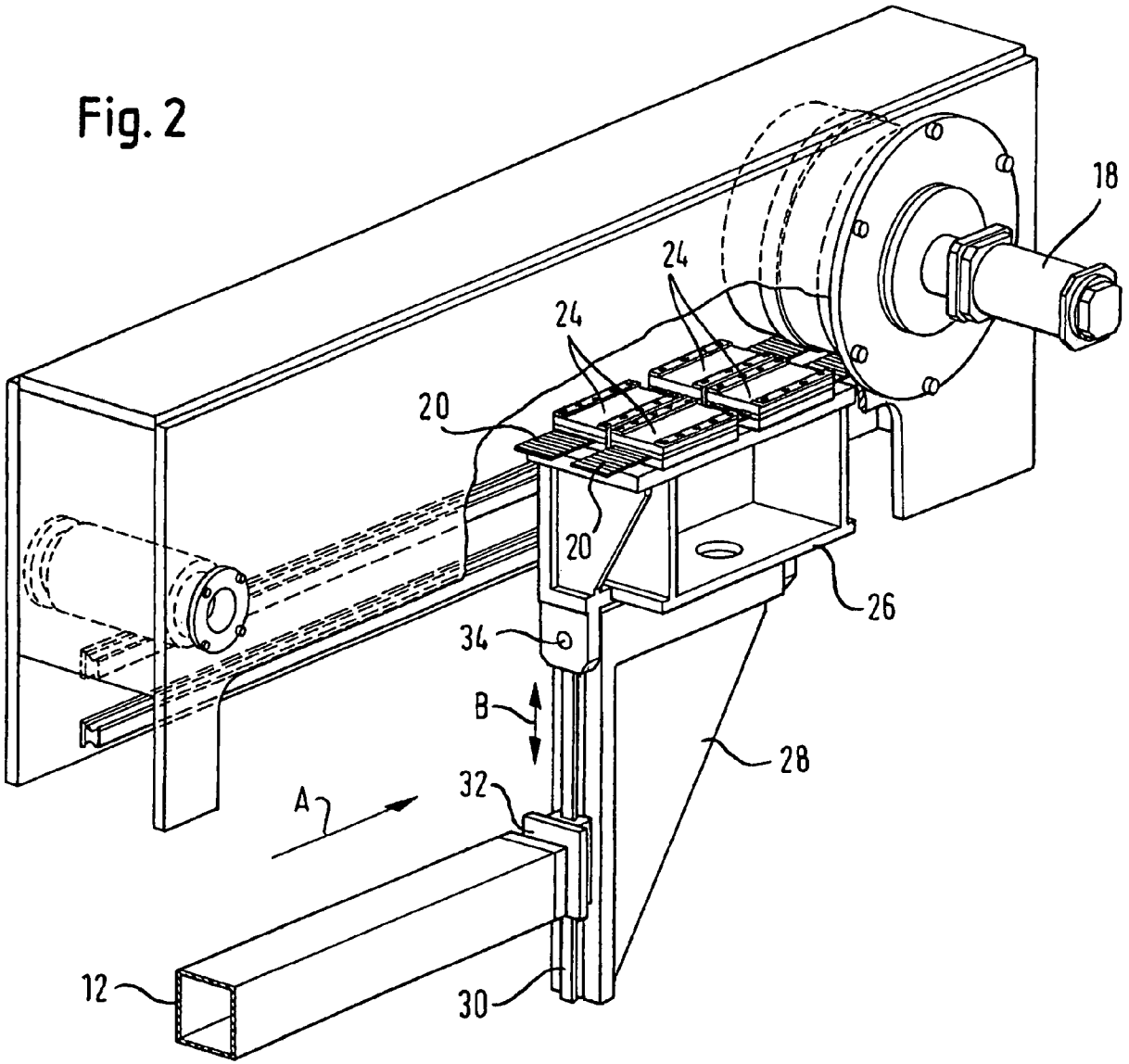
FIG. 2 shows a perspective view of part of the transferring device according to the invention.

FIG. 2 shows a perspective view of a section of the gripper rail 12 and its connection to the advancing drive 18. In the example shown, the advancing drive 18 is embodied in the form of a belt drive that drives two belts 20. Attached to these belts 20 by means of suitable clamps 24 is a slide 26 on which an arm 28 is pivotably mounted. The arm 28 can in particular be pivoted about an axis substantially parallel to the advancing direction A. In the case shown, the arm 28, is, substantially, embodied as a triangle, but it can have any other shape. The gripper rail 12 is engaged with the arm 28 in such a way that movements in the advancing direction A, and opposite to this, may be transmitted to the gripper rail 12. In the example of an embodiment shown, the arm 28 has a guide 30. The guide is engaged with a sliding block 32 in such a way that it may be displaced in the direction of extension (in the position shown in FIG. 2 identical to the lifting direction B) of the arm 28. By means of at least one undercut on the guide 30 and at least one correspondingly designed projection on the sliding block 32, movements may be transmitted in the direction of advancing direction A from the arm to the sliding block. The connection between the sliding block 32 and the gripper rail 12 is also suitable to ensure that forces may be transmitted in said direction. However, the gripper rail is also connected to the sliding block 32 about an axis parallel to direction A.

This degree of freedom is required to ensure that the connection between the gripper rail 12 and the arm 28 does not impede movements for example in a lateral direction, i.e. for opening or closing. If the gripper rail is moved in this lateral direction, the gripper rail 12 remains in its orientation as shown in FIG. 2. The sliding block 32, which is guided by the guide 30, twists slightly. Similarly, the arm 28 pivots slightly about its axis 34. Provided that the gripper rail 12 does not make any movement in the vertical direction, i.e. in direction B, the sliding block 32 is slightly displaced along the guide 30 in order to compensate the changed height of the arm 28 as a result of its pivotal movement about the axis 34. In any case, the new type of connection for the gripper rail 12 to the arm 28 does not impede the other movements of the gripper rail 12 or influence them in any other way. At the same time, the transmission of the required advancing and return movement to the gripper rail 12 is able to take place in a simple way without it being necessary to move high masses. The direct connection of the gripper rail 12 to the arm 28 enables complicated slides etc between these elements to be avoided.

Reference is also made to the fact that FIG. 1 shows a position of the arm 28 horizontally offset from the position shown in FIG. 2, for example as the result of a closing movement of the gripper rail 12. In addition, it is evident from FIG. 1 that the connection between the other gripper rail and advancing drive assigned thereto is embodied as a mirror image of the arrangement shown in FIG. 2.

The invention claimed is:

1. Transferring device having;

at least one gripper rail which can be brought into engagement with at least one workpiece and which can be driven in a lifting direction, a closing direction and an advancing direction, at least one lifting drive and/or at least one closing drive, at least one advancing drive, and an arm connected to the advancing drive pivotably about an axis substantially parallel to the advancing direction, wherein the gripper rail is directly engaged with the arm in the advancing direction and can be displaced in a direction perpendicular thereto, wherein the arm comprises a turning/pushing unit, and wherein the turning/pushing unit comprises a guide and a sliding block guided thereon and attached rotatably to the gripper rail.

2. Transferring device according to claim 1, wherein the arm has an overload protection in the form of a component having a defined breaking or release force.

3. Transferring device according to claim 2, wherein the overload protection is provided in the area of the pivotable mounting of the arm.

4. Transferring device according to claim 1, which comprises two gripper rails and two advancing drives assigned each to the gripper rails, said drives being controllable independently of each other.

* * * * *